US007461689B2

(12) United States Patent
Merklein et al.

(10) Patent No.: US 7,461,689 B2
(45) Date of Patent: Dec. 9, 2008

(54) THERMAL CYCLING RESISTANT TUBE TO HEADER JOINT FOR HEAT EXCHANGERS

(75) Inventors: Brian Merklein, Hartford, WI (US); Roy J. Ingold, Racine, WI (US); Jeffrey Verhagen, Little Chute, WI (US); Tony Do, Franklin, WI (US)

(73) Assignee: Modine Manufacturing Company, Racine, WI (US)

( * ) Notice: Subject to any disclaimer, the term of this patent is extended or adjusted under 35 U.S.C. 154(b) by 525 days.

(21) Appl. No.: 10/858,317

(22) Filed: Jun. 1, 2004

(65) Prior Publication Data

US 2005/0263263 A1 Dec. 1, 2005

(51) Int. Cl.
*F28F 9/007* (2006.01)

(52) U.S. Cl. ..... 165/134.1; 165/173; 165/907; 29/890.043

(58) Field of Classification Search ..... 165/76, 165/134.1, 151, 153, 173–176, 178, 906; 29/890.043
See application file for complete search history.

(56) References Cited

U.S. PATENT DOCUMENTS 1,770,208 A * 7/1930 Kemnal ..... 165/174
1,847,743 A * 3/1932 Anderson ..... 165/76
2,209,974 A 8/1940 Jacobus
2,258,041 A * 10/1941 Young ..... 165/174
4,125,280 A 11/1978 Kuzel
4,254,819 A * 3/1981 Worrell ..... 165/134.1
4,369,837 A 1/1983 Moranne
4,501,321 A 2/1985 Real et al.
4,805,693 A 2/1989 Flessate
5,052,475 A 10/1991 Grundy
5,174,372 A 12/1992 Potier et al.
5,226,235 A 7/1993 Lesage
5,299,636 A 4/1994 Potier
5,301,748 A 4/1994 Potier
5,311,934 A * 5/1994 Potier ..... 165/173
5,490,560 A 2/1996 Helms et al.
5,511,613 A 4/1996 Mohn et al.
5,535,821 A * 7/1996 Potier ..... 165/173

(Continued)

FOREIGN PATENT DOCUMENTS

GB 2048451 A * 12/1980 ..... 165/906
GB 2394037 A * 4/2004

*Primary Examiner*—Leonard R Leo
(74) *Attorney, Agent, or Firm*—Michael Best & Friedrich LLP

(57) ABSTRACT

A reduction in tube to header joint failures in a heat exchanger having spaced headers (12,14), elongated, side-by-side parallel spaced tube slots (22) in the headers (12,14) along the length thereof and a plurality of flattened tubes (26) having ends (24) received in the tube slots (22) and metallurgically bonded to the header (12,14) thereat was achieved through the use of a reinforcing structure (38) having at least two projections (40) having a cross sectional shape complimentary to at least a part of the surface of the tubes (26) at their ends (24) and a length sufficient to extend along the tube ends (24) to a location past the metallurgical bonds between the tube ends (24) and a header (12,14), and a spine (44) extending transverse to the projection. Also disclosed is a reinforcing structure (38) and a method of reinforcing the tube to header joints in a heat exchanger.

41 Claims, 3 Drawing Sheets

U.S. PATENT DOCUMENTS

| | | | |
|---|---|---|---|
| 5,538,079 | A | 7/1996 | Pawlick |
| 5,894,649 | A | 4/1999 | Lambert et al. |
| 6,330,747 | B1 | 12/2001 | Lambert et al. |
| 6,460,610 | B2 | 10/2002 | Lambert et al. |
| 6,843,097 | B2 | 1/2005 | Tatsuta et al. |
| 7,143,824 | B2 | 12/2006 | Emrich et al. |

* cited by examiner

THERMAL CYCLING RESISTANT TUBE TO HEADER JOINT FOR HEAT EXCHANGERS

FIELD OF THE INVENTION

This invention relates to heat exchangers, and more particularly, to improved tube to header joints with increased resistance to failure as a result of thermal cycling.

BACKGROUND OF THE INVENTION

The art of heat exchange has been active for hundreds of years. One type of heat exchanger that has evolved over this time period is one that utilizes so-called tube to header joints. In this type of heat exchanger, two headers are typically located in spaced parallel relation. Each header is provided with a plurality of tube receiving apertures and the apertures in one header are aligned with corresponding apertures in the other. Tubes extend between and have their ends received in the headers. The ends are also sealed to the headers and then tanks are fitted to the headers in sealed relation to receive and confine a heat exchange fluid passing from the tank and header on one end of the assembly through the tubes to the tank and header on the other end of the assembly. In some instances, one or more baffles may be employed to provide for so called multi-passing.

Whatever the particular flow path arrangement, it is common to place fins between the respective tubes. When so-called flattened tubes are used, it is customary to utilize so-called serpentine fins while when round tubes are employed, and in some instances even with flattened tubes, plate fins may be employed as well.

In use, many of these heat exchangers have intermittent duty cycles, which is to say that a heat exchange fluid of a temperature higher or lower than that of the temperature of another heat exchange fluid is passed through the tubes from one header to the other as mentioned previously.

As a result, dimensional changes in the tubes and headers occur as a result of the heating or cooling of the tubes and the header and the resulting thermal expansion or contraction. Where the tubes are bonded to the headers, such thermal cycling induces stresses at the tube to header joints. These stresses in turn ultimately cause fatigue which is generally concentrated in the walls of the tube (since tube walls are typically thinner than headers and header flanges which may receive the ends of the tubes) until a fracture results causing leakage, and thus failure of the heat exchanger.

Such failure is highly undesirable. In the case where heat exchanger may be repaired, the system in which it is used must be necessarily shut down for a sufficient period to allow the repair to be undertaken. Where the heat exchanger cannot be repaired, the same problem is present plus there is the additional cost of providing an entirely new heat exchanger to replace that which has failed. Consequently, heat exchanger failure due to thermal cycling is highly undesirable and should be avoided.

In many incidences, the prior art, to reduce thermal cycling failure, has simply resorted to using heavier components as, for example, tubes and/or headers of greater thickness. While this approach works well, it adds to the cost of the heat exchanger because greater thicknesses mean that more material must be employed in the fabrication of the heat exchanger, thereby raising material cost. In addition, weight is increased and in various intended uses, as for example vehicular applications, weight is desirably reduced rather than increased to achieve better fuel economy.

Another solution is proposed in PCT patent publication WO 03/093751 A2 published on Nov. 13, 2003. In this patent document, an insert whose periphery is complimentary to the periphery of the interior of the heat exchanger tubes at their ends is inserted into the ends of the tubes so as to be present at the tube header joints and provide additional strength to resist fatigue imposed by thermal cycling.

While little is known about the effectiveness of this proposal, it has at least one clear drawback. That is that each insert must be assembled to a tube end in individual operation thereby increasing assembly costs.

Furthermore, it is believed by the present applicants that its implementation utilizes more material than is actually required to attain the goal of increasing the thermal cycle life of a heat exchanger.

The present invention is directed to overcoming the foregoing difficulties.

SUMMARY OF THE INVENTION

It is the principal object of the invention to provide a new and improved heat exchanger of the type having tube to header joints. More specifically, it is an object of the invention to provide a significant increase in the thermal cycle life of such a heat exchanger while minimizing the material requirements of the solution as well as the assembly effort needed to implement it in heat exchanger production.

It is also a principal object of the invention to provide an insert for strengthening the ends of flattened heat exchanger tubes in the area where the tubes would be metallurgically bonded to a header. A further principal object of the invention is to provide a method of strengthening the tube to header joint in a heat exchanger having flattened tubes.

According to a first facet of the invention, the objects of the invention are realized in a heat exchanger having at least one header together with the elongated side-by-side parallel spaced tube slots in the header along the length thereof. A plurality of flattened tubes having ends received in the tube slots and metallurgically bonded to the header thereat are also provided. The invention contemplates the improvement which includes an insert having at least two projections, each having a cross sectional shape complimentary to at least a part of the surface of the tubes at their ends and a length sufficient to extend along the tube ends to a location past the metallurgical bonds between the tube ends and the header. The insert further includes a spine generally transverse to and mounting the projections with their centerlines in spaced relation a distance that is an integral multiple of the distance between the centerline of adjacent ones of the tubes.

In a preferred embodiment of the invention, the integral multiple is one (1).

In one embodiment of the invention, there are sufficient projections on the spines so as to be receivable in each of the tubes of the heat exchanger while in another embodiment, there may be as few as two projections on the spine for use in strengthening the end most tubes nearest the sides of a heat exchanger.

In one embodiment of the invention, the spine includes an integral clip at each of the projections with the clip opening in the same direction as each projection extends from the spine. The clip can be a tab having one end joined at the spine and an opposite free end punched out of a part of a corresponding projection at its mounting to the spine. The clip may be clipped over the end of the tube to hold the projection in place during assembly.

In a highly preferred embodiment, the projection, the spine and the tabs are formed of a single strip of metal.

In another embodiment of the invention, the surface of the tubes to which the projections are fitted is an interior surface of the tubes and the projections extend into the corresponding ones of the tubes.

One embodiment of the invention contemplates that the projections, remote from the spine, are provided with a pilot formation freely received within the tube end.

Preferably, all but the ends of the projection have a slightly greater side to side dimension than the side to side dimension of the tubes and the projections are interference fitted within the tube ends.

According to another facet of the invention, there is provided an insert for strengthening the ends of flattened heat exchanger tubes in the area where the tubes would be metallurgically bonded to a header. The insert includes an elongated strip of metal formed to have a plurality of spaced C-shaped deformations along its length at distances corresponding to the spacing between flattened tubes to be placed in a heat exchanger. Each C-shaped deformation has a convex side dimensioned to nominally mate with a concave or convex surface at the rounded end wall of a flattened tube. The strip is relieved between the C-shaped deformations so that the C-shaped deformations project a predetermined distance from a side of the strip. The predetermined distance is equal to a desired length of extension of each C-shaped deformation along the end of a flattened tube.

In one embodiment, the strip further includes a plurality of clips, one in each C-shaped deformation for holding inserts on the ends of flattened tubes. Each such clip comprises a tab having a free end terminating in a piloting section extending away from the corresponding C-shaped deformation together with an offset section at the point of connection of the tab to the strip. According to another embodiment of the invention, the end of each C-shaped deformation is provided with a piloting formation to freely enter the tubes and a side to side dimension slightly greater than the interior side to side dimension of the tubes to be interference fitted therein.

According to still another facet of the invention there is provided a method of strengthening the tube to header joint and the heat exchanger having flattened tubes which includes the steps of: a) inserting the ends of flattened tubes into the tube slots of a header for a heat exchanger; b) placing C-shaped inserts connected by a spine on the ends of the tubes such that the inserts are least nominally in contact with the rounded walls of the tubes and extend past the interface of the tubes and header whereat tube to header joints are to be formed; and c) metallurgically bonding the header, the tubes and the inserts into a unitary structure.

In one embodiment, step b) includes clipping the inserts to the tubes using tabs integrally formed in the spine at the location of each insert while according to another embodiment, step b) includes interference fitting the inserts within the tube ends. Preferably, step b) is performed by inserting the inserts into the ends of the tubes to be in nominal contact with the interior rounded walls of the tubes.

According to one facet of the invention, an insert is provided for strengthening an end of a flattened heat exchanger tube in the area where the tube would be metallurgically bonded to a header. The insert includes a C-shaped projection having a concavo-convex shape dimensioned to nominally mate with a concave or convex surface at the rounded end wall of a flattened tube. The insert has a length with the concavo-convex shape that will extend from an open end of the tube past the location where the tube would be metallurgically bonded to a header.

In accordance with one facet of the invention, an insert is provided for strengthening the end of a flattened heat exchanger tube in the area where the tube will be metallurgically bonded to the header, with the tube having a rectangular cross section defined by two spaced broad sides joined by two spaced short sides. The insert includes a projection having a length sufficient to extend from an end of the tube past a point where the tube would be metallurgically bonded to a header. The length has a cross-sectional shape adapted to conform to one of the short sides of the tube to allow the projection to be bonded to the one of the short sides of the tube. The cross-sectional shape of the projection extends over less than one half of the broad sides adjacent the one of the short sides.

According to another facet of the invention, a method is provided for strengthening a tube to header joint in a heat exchanger having a flattened tube. The method includes the steps of:

a) inserting the end of a flattened tube into a tube slot of a header for a heat exchanger;

b) placing an insert having a C-shaped projection on the end of the tube such that the projection is at least nominally in contact with a rounded wall of the tube and extends past an interface of the tube and the header whereat the tube to header joint is to be formed; and c) metallurgically bonding the header, the tube, and the insert into a unitary structure.

Other objects and advantages will become apparent from the following specification taken in connection with the accompany drawings.

DESCRIPTION OF THE PREFERRED EMBODIMENTS

Exemplary embodiments of the invention will be described herein in the context of heat exchangers generally and no restriction to any particular use of the heat exchanger is intended except insofar as a expressly stated in the appended claims. However, it is to be noted that the invention can be utilized with its greatest efficacy in heat exchangers employing flattened tubes of relatively large minor dimension as for example, charge air coolers. Nonetheless, the invention may also usefully be employed in heat exchangers intended for other uses and having tubes with a relatively small minor dimension as, for example, vehicular radiators. The invention can be employed with flattened tubes of both the so-called fabricated type or the extruded type. Fabricated tubes are typically formed of fairly thin strip of metal formed upon itself with a welded seam and the greatest benefit of the invention is achieved when used with fabricated tubes. Nonetheless, no limitation to fabricated tubes is intended except insofar as expressly stated in the appended claims.

In the usual case, heat exchanger components, other than the tank, will be formed of aluminum and metallurgically bonded as by brazing. However, other materials such as copper or brass or even steel may be used with metallurgical bonding provided by brazing, welding or soldering. In short, the invention is susceptible to advantageous use in any of a variety of heat exchangers utilizing flattened tubes and having tube to header joints subject to thermal fatigue.

Figure 1:
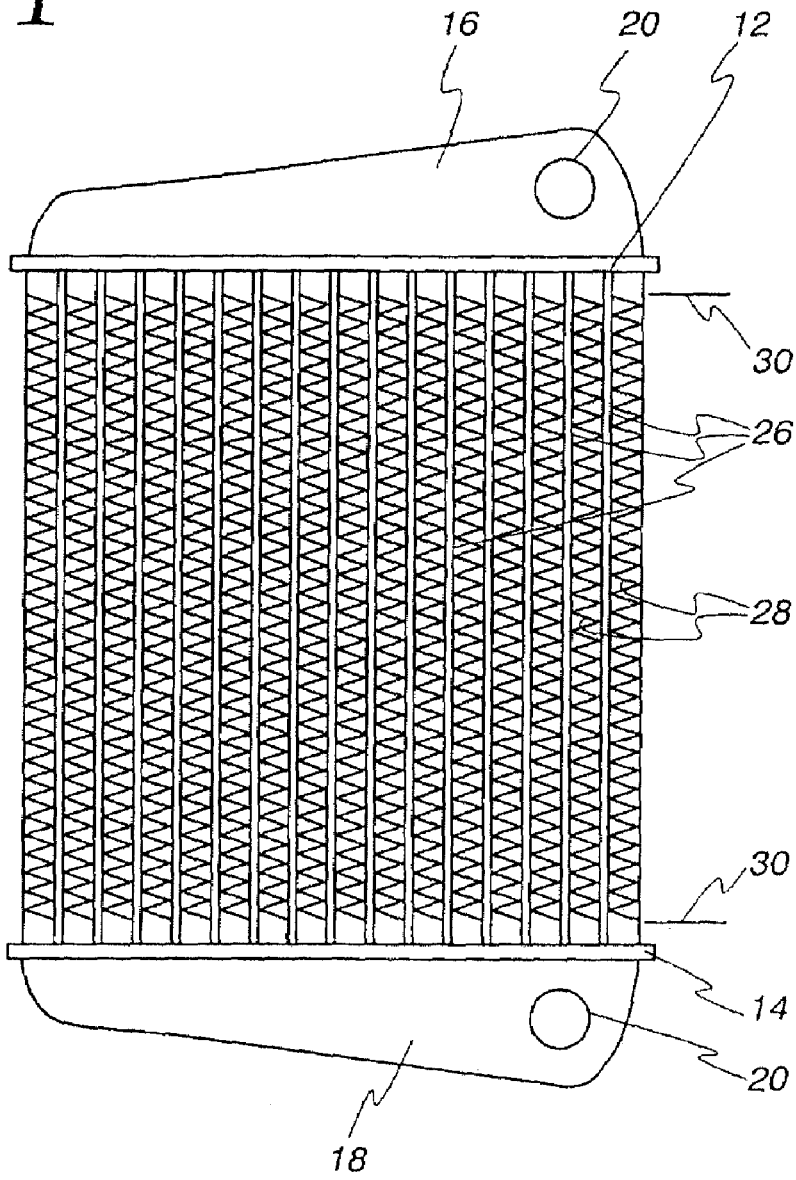
FIG. 1 is an elevational view of a heat exchanger embodying the invention.

With the foregoing in mind, attention is directed to FIG. 1 where a heat exchanger, specifically a charge air cooler, made according to the invention, is illustrated. The same includes two parallel headers 12,14. One side of each header 12, 14 is provided with a tank 16, 18, having an inlet or outlet port 20. The tank 16 and 18 may be made of metal or plastic as desired and is sealed to the header about its periphery.

Figure 2:
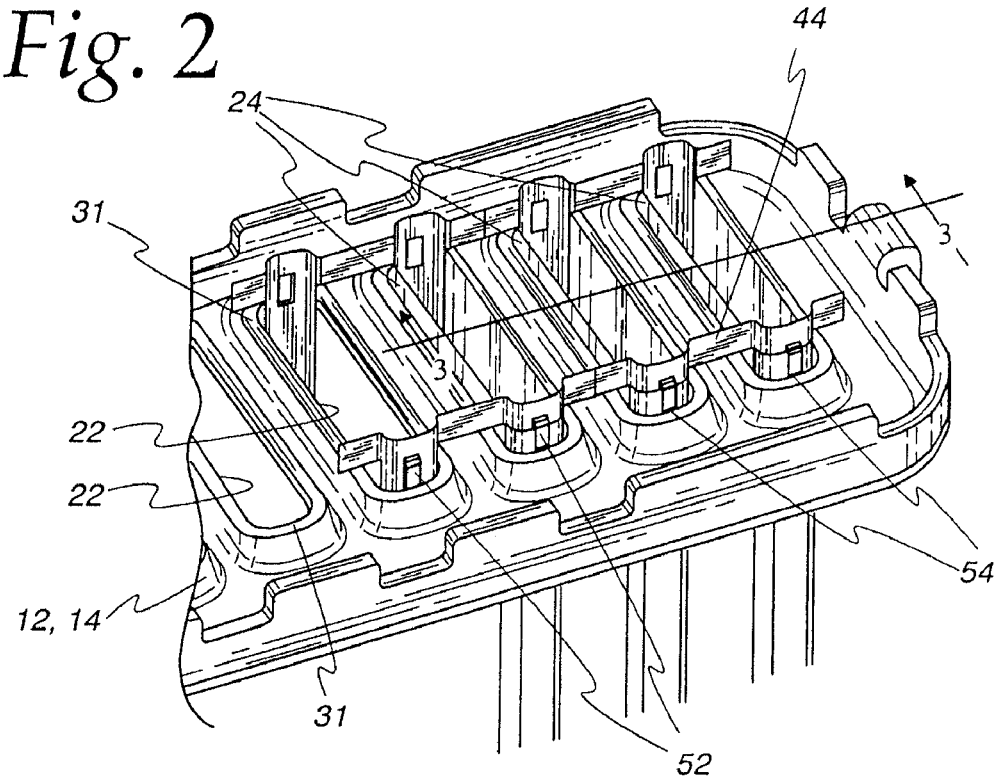
FIG. 2 is a fragmentary, perspective view of a corner of the heat exchanger with the tank removed.
Figure 3:
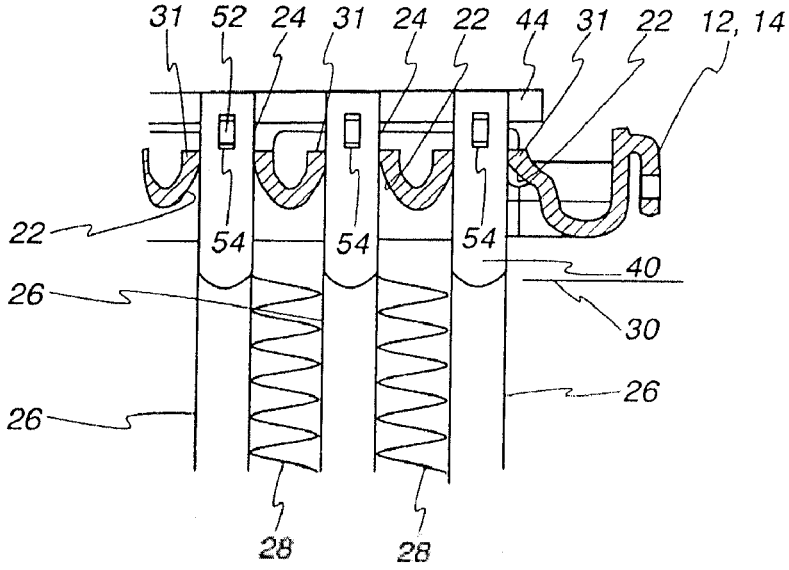
FIG. 3 is a fragmentary, sectional view taken approximately along the line 3-3 in FIG. 2.

As seen in FIGS. 2 and 3, each of the headers 12, 14, along its length, includes a plurality of elongated tube slots 22 in side-by-side spaced relation and extending generally transverse to the length of the header 12,14. The tube slots 22 receive the ends 24 of flattened tubes 26 which, as seen in FIG. 1, extend between the headers 12,14 to establish fluid communication between the volumes defined by each header 12, 14, and its associated tank 16,18.

In the usual case, fins embrace the tubes 26 and typically, the fins will be serpentine fins 28 as illustrated in FIGS. 1 and 3. However, it is to be noted that plate fins can be utilized if desired.

The fins are located along virtually the entire length of the tubes 26, stopping a few millimeters short of the respective headers 12, 14. As the fins 28 are typically placed in an air stream with air serving as one of the heat exchange fluids, a line at which the fins stop in adjacency to the headers 12, 14 may be termed the ambient air fin line and is designated 30 in the drawings. The significance of the ambient air fin line will become apparent hereinafter.

Returning to FIGS. 2 and 3, each of the tube slots 22 is surrounded by a flange or collar 31 which extends about the entirety of each tube slot 22 as can be seen in the left hand apart of FIG. 2. It is to the flanges 31 that the tube ends 24 are metallurgically bonded, and it is at this location where stresses caused by thermal cycling are predominately found. It should be understood that while the illustrated embodiments show the flanges 31 extending inwardly toward the interior side of the headers 12,14, it may be desirable in some applications for the flanges 31 to extend outwardly toward the exterior side of the headers 12, 14, or for there to be no flanges on the headers 12, 14 but simply openings that are sized to form an appropriate bond joint with the tubes 26.

Figure 4:
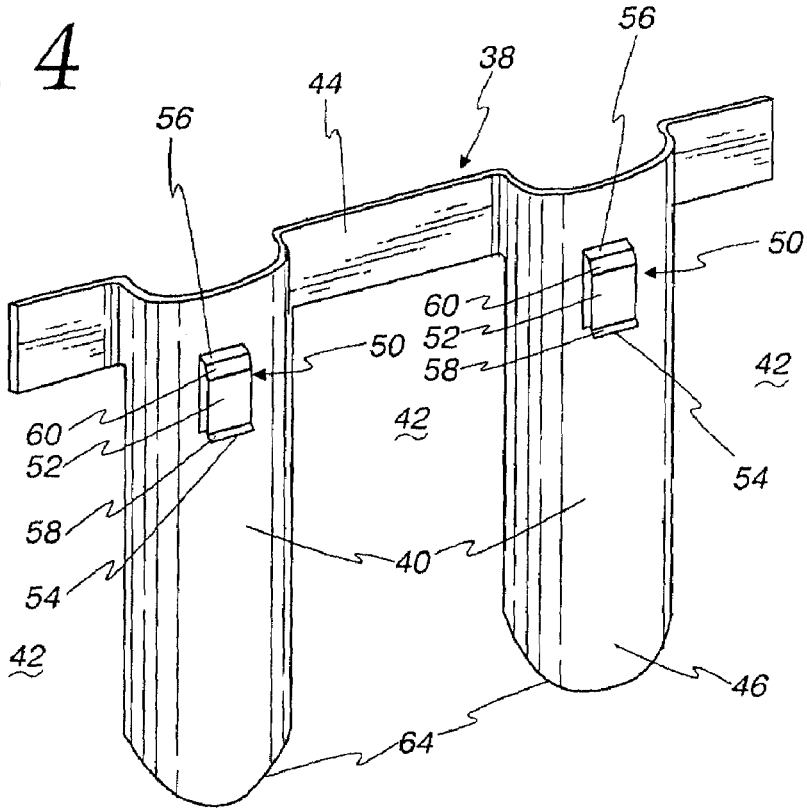
FIG. 4 is a perspective view of an insert structure employed in implementing the invention.
Figure 5:
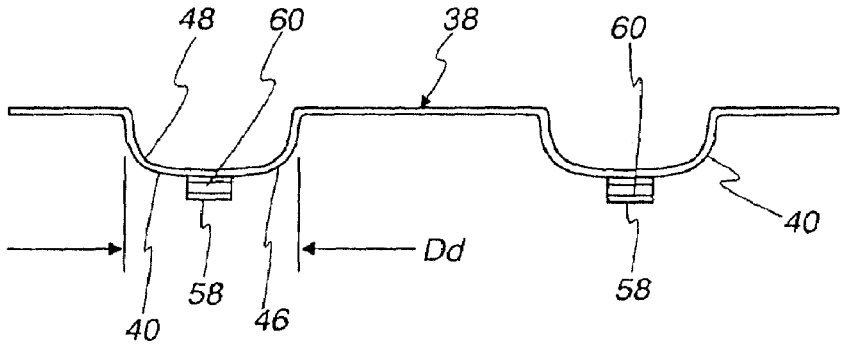
FIG. 5 is a plan view of the insert structure.

FIGS. 4 and 5 illustrate an insert made according to the invention that is intended to strengthen each of the tubes 26 locally at its ends 24, that is, in the area where the metallurgical bond with the flanges 31 exists. The insert is particularly suitable for use with fabricated tubes because fabricated tubes, as is well known, can be made with a thinner wall thickness than can extruded tubes and at a lower cost. Thus, a cost saving due to the use of less material in fabricating the tubes 26 is realizable through the use of fabricated tubes. However, the thinner wall thickness can make fabricated tubes more likely to fail at the tube to header joints between the tube ends 24 and the flanges 31, particularly at the noses of the tubes 26, that is, the rounded tube ends connecting the flat sides of the flattened tubes.

Referring to FIG. 4, one form of reinforcing insert 38 is illustrated and the same is a unitary structure which is to say it is made from a single sheet of thin metal whose thickness is selected as desired for the particular use. Through rolling or punching operations as desired, the sheet is formed to have a plurality of C-shaped deformations 40 formed along the length of the sheet and separated from one another by reliefs or cutout sections 42. The spacing of the C-shaped deformations, also referred to herein as projections or inserts, is on the same centers as the tube slots 22 in the headers 12, 14. The cutouts 42 are formed so as to leave a spine 44 on one end of the structure which connects the C-shaped deformations 40 into the unitary structure as mentioned previously.

In a preferred embodiment, the projections 40 are intended to enter the interior of the tubes 26 at their ends 24 as illustrated in FIG. 2 until the spine 44 abuts the very ends 24 of the tubes 26. The projections are concavo-convex with a convex surface 46 and an opposite concave surface 48. Where the reinforcing structure is to be inserted into the tube ends 24, the convex surface 46 is formed to be complimentary to the nose of the tube 26 in which it is received, which is to say, when placed in each tube 26, will be a nominal contact therewith. By "nominal" contact, it is meant that any space between the C-shaped deformations 40 and the interior tube walls is sufficiently small that it will be filled by bonding material such as braze metal or solder so that the C-shaped deformations 40 are metallurgically bonded over their surfaces 46 to the facing interior surface of the nose of the tubes 26.

To properly position the reinforcing structure 38, one embodiment of the invention contemplates the use of spring clips, generally designated 50, on each of the C-shaped deformations 40. The spring clips 50 are formed out of the strip of metal making up the reinforcing structure 38 to provide tabs 52 having free ends 54 and opposite attached ends 56, the latter approximately at the level of the spine 42. The free ends 54 are located to extend from the attached ends 56 a distance approximately equal to the length of the tube ends 24 that extends above the upper extremity of flanges 31 as can be seen in FIGS. 2 and 3.

Near the attached ends 56, the tabs 52 include an offset 60 which typically will be about equal to the wall thickness of the tubes 26. The free ends 54 terminate in an outwardly directed, piloting formation 58 so as allow the reinforcing structure 38 to be quickly piloted into position on the tube ends 24.

In the usual case, the construction will be such that the space between the surfaces 46,48 of any C-shaped deformation 40 is just slightly less than the wall thickness of the tubes 26 such that the inherent resilience of the tabs 50 will frictionally grasp the tube ends 24 and hold the surfaces 46 in nominal contact with the interior walls of the tubes 26 at their noses.

To facilitate initial insertion of the C-shaped deformations 40 into the tube ends 24, the ends of the deformation 40 remote from the spine 44 are rounded as shown in 64 to provide a further piloting function during the initial part of an insertion operation.

In many cases, the spring clips 50 may be omitted by providing the C-shaped deformations 40 at all but their rounded ends 64 with a side to side dimension that is slightly greater than the side to side interior dimension of the tube ends 24. With reference to FIG. 5, the side to side dimension of the C-shaped deformations 40 is shown at Dd. Thus, when the C-shaped deformations 40 are inserted into the tube ends 24, they will initially freely enter tube ends because of the rounded ends 64 on the C-shaped deformations and thereafter be interference fitted within the tube ends 24 and frictionally held therein with nominal contact, as mentioned above, existing between the surfaces 46 and the interior surfaces of the tubes 26 at their ends 24.

The reinforcing structure 38 may be made of the same aluminum or aluminum alloy as the tubes 26 when the tubes 26 are formed of aluminum. Alternatively, they may be formed of steel or aluminized steel or other strengthening materials so long as the material is capable of being brazed, welded or soldered to the material of which the tubes 26 are formed.

It has been determined by the inventors that the majority of tube to header joint failures due to thermal cycling occur at the noses of the tubes 26. The reinforcing structure 38 just described provides sufficient reinforcing of the relatively thin walls of the tubes 26 at this location by increasing their thickness an amount equal to the thickness of the strip of which the reinforcing structure 38 is formed plus that added by braze metal or solder. Consequently, an excellent improvement in thermal cycle life occurs without the use of large quantities of material in forming the reinforcing structure 38. For example, the material removed by the presence of the relief 42 is substantial and, of course, the material savings realized by providing reinforcing only at the noses, rather than about the entire periphery of the ends 24 of the tubes 26 is likewise substantial. The use of the spine 44 does require the use of material not necessary in other proposals but the cost of such additional material, because of the relative narrowness of the spine 44, is more than offset by the fact that the reinforcing structure for several tubes may be inserted in one operation, rather than individually, for each tube requiring reinforcing.

It is also to be noted that the inventors have determined that failure due to thermal cycling is most apt to occur in the endmost tube to header joints along the length of a header 12, 14. Thus, in many instances, the reinforcing structure 38 may have as few as two of the C-shaped deformations 40 and be placed only in the two tubes 26 at each end of a header 12, 14, providing an additional material saving.

While the preferred embodiment of the invention contemplates that the C-shaped deformations 40 be inserted into the ends 24 of the tubes 26, it is also contemplated that in some instances, they may be applied to the exterior of the tube ends 24. In such a case, the direction of extension of the tabs 52, if used, will be toward the concave surface 48 of each deformation 40 rather than from the convex surface 46 thereof. If the method of attachment is to employ an interference fit in the case of exteriorly applied reinforcing structures, then the side to side dimension of each deformation 40 on the concave side 48 will be made slightly less than the side to side exterior dimension of the noses of the tubes 26 at the ends 24. When the reinforcing structure is applied exteriorly of the tube ends 24, it will also be necessary to slightly form the noses of the tubes at the ends 24 so that the convex surfaces 46 of the deformations 40 will merge smoothly into the flat side of the tube ends 24 sufficiently to allow the tube ends 24 with the exteriorly placed reinforcing structure 38 in place to be readily metallurgically bonded and sealed to the flanges 31 on the headers 12, 14.

While it is preferred for the insert to have a plurality of deformations 40, in some applications, it may be advantageous for the insert to be limited to a single one of the deformations 40 for use with a single tube. It should be appreciated that in such a construction, all of the previously described features could be incorporated with the insert and the deformation 40.

In all cases, the length of the C-shaped deformations 40 should be such as to extend about 4-5 mm past the location whereat the metallurgical bonding between the flanges 31 and the tube ends 24 occurs. To assure that such occurs, it is desirable that the C-shaped deformations 46 have their rounded ends 64 extend at least to the ambient air fin line 30 as illustrated, for example, in FIG. 3.

From the foregoing description, it will be appreciated that using a reinforcing structure according to the invention provides a considerable material savings in that the amount of material employed in forming the reinforcing structure is substantially reduced. Furthermore, the same allows the reinforcing structure for several tubes to be inserted in one operation as opposed to an individual operation for each tube, thereby providing a cost savings in the form of decreased labor content in the finished product.

Even more importantly, it has been determined that thermal cycle life of the resulting heat exchanger is vastly increased. A comparison of two otherwise identical charge air coolers, one provided with the reinforcing structure of the invention in all tube ends, and one entirely without reinforcing structure, in thermal cycling test indicated that the heat exchanger made according to the invention improved the average thermal cycle life from 767 cycles for the heat exchanger not utilizing the invention to 9500 cycles for the heat exchanger utilizing the invention.

The invention claimed is:

1. A heat exchanger comprising:

at least one header, elongated side-by-side parallel spaced tube slots in the header along the length thereof, a plurality of flattened tubes having ends received in the tube slots and metallurgically bonded to the header thereat, an insert having at least two projections, each having a cross sectional shape complementary to a side surface of the tubes at their ends and a length sufficient to extend along the tube ends to a location past the metallurgical bonds between the tube ends and the header, and a spine generally transverse to and mounting said projections with their centerlines in spaced relation a distance that is an integral multiple of the distance between centerlines of adjacent ones of said tubes, the spine and at least one of the projections formed from a sheet material having a substantially equal thickness.

2. The heat exchanger of claim 1 wherein said integral multiple is one (1).

3. The heat exchanger of claim 1 wherein said spine includes an integral clip at each said projection, said clip opening in the same direction as each projection extends from the spine.

4. The heat exchanger of claim 3 wherein each said clip is a tab having one end joined to the spine and opposite free end punched out of a part of the corresponding projection at its mounting to the spine.

5. The heat exchanger of claim 4 wherein said projections, said spine and said tabs are formed of a single strip of metal.

6. The heat exchanger of claim 3 wherein said tube slots are surrounded by flanges and said tube ends extend through said tube slots past said flanges a predetermined distance and said clips have a length no greater than said predetermined distance.

7. The heat exchanger of claim 6 wherein each said clip is a tab having one end joined to the spine and an opposite free end punched out of a part of the corresponding projection at its mounting to the spine, each said free end having a pilot section directed away from said spine.

8. The heat exchanger of claim 1 wherein said spine includes an integral clip at each said projection, said clip opening in the same direction as each projection extends from the spine, said clips being spring clips to frictionally grasp said tube ends.

9. The heat exchanger of claim 1 wherein said surface is an interior surface of the tubes and said projections extend into corresponding ones of said tubes.

10. The heat exchanger of claim 9 wherein ends of said projections remote from said spine are provided with a pilot formation freely received within said tube ends.

11. The heat exchanger of claim 10 wherein all but the ends of said projections have a slightly greater side-to-side dimension than said tubes and said projections are interference fitted in said tube ends.

12. The heat exchanger of claim 9 wherein said projections have a side-to-side dimension slightly greater than the side-to-side dimension of the tube ends in which they are received to be inference fitted within said tube ends.

13. The heat exchanger of claim 1 wherein ends of said projections remote from said spine are provided with a pilot formation freely received within said tube ends.

14. The heat exchanger of claim 13 wherein said pilot formation comprise rounded ends on said projection remote from said spine.

15. The heat exchanger of claim 1 wherein fins are located between said tubes and said length is at least about 4 mm past said header.

16. The heat exchanger of claim 1 wherein fins extend between said tubes with an endmost fin closest said header defining an ambient air fin line, and said length extends at least to said ambient air fin line.

17. An insert for strengthening the ends of flattened heat exchanger tubes in the area where the tubes would be metallurgically bonded to a header, the insert comprising: an elongated strip of metal formed to have a plurality of spaced C-shaped deformations along its length at distances corresponding to the spacing between flattened tubes to be placed in a heat exchanger, each C-shaped deformation having a concavo-convex shape dimensioned to nominally mate with a concave or convex surface at the rounded end wall of a flattened tube, said strip being relieved between said C-shaped deformations so that said C-shaped deformations project a predetermined distance from a side of said strip, said predetermined distance being equal to a desired length of extension of each C-shaped deformation along the end of a flattened tube.

18. The insert of claim 17 wherein said strip further include a plurality clips, one at each C-shaped deformation, for holding the insert on the ends of flattened tubes.

19. The insert of claim 18 wherein each said clip comprises a tab formed from said strip and having a free end extending away from said side of said strip.

20. The insert of claim 19 wherein each said free end terminates in a piloting section extending away from the corresponding C-shaped deformation, and the end of said tab opposite said free end includes an offset section of a length about equal to the wall thickness of a flattened tube.

21. The insert of claim 17 wherein each said C-shaped deformation terminates in a free end having a pilot formation thereon to be freely received in a flattened tube end.

22. The insert of claim 21 wherein said pilot formation is a rounded end.

23. The insert of claim 22 wherein all but the ends of said C-shaped deformations have a slightly greater side-to-side dimension than said tubes and said C-shaped deformation are interference fitted in said tube ends.

24. The insert of claim 17 wherein all but the ends of said C-shaped deformations have a slightly greater side-to-side dimension than said tubes and said C-shaped deformation are interference fitted in said tube ends.

25. A method of strengthening the tube to header joints in a heat exchanger having flattened tubes comprising the steps of: a) inserting the ends of flattened tubes into tube slots of a header for a heat exchanger; b) placing C-shaped inserts connect by a spine on the ends of the tubes such that the inserts are at least nominally in contact with the rounded walls of the tubes and extend past an interface of the tubes and header whereat tube to header joints are to be formed; and c) metallurgically bonding the header, the tubes and the inserts into a unitary structure.

26. The method of claim 25 wherein step b) includes clipping the inserts to the tubes using tabs integrally formed on said spine at the location of each insert.

27. The method of claim 25 wherein step b) includes interference fitting the inserts within the tube ends.

28. The method of claim 25 wherein said inserts are, during step b) inserted into the ends of the tubes and are in said nominal contact with the interior rounded walls of the tubes.

29. An insert for strengthening an end of a flattened heat exchanger tube in the area where the tube would be metallurgically bonded to a header, the insert comprising: a C-shaped projection having a concavo-convex shape dimensioned to nominally mate with a concave or convex surface at the rounded end wall of a flattened tube, the insert having a length with the concavo-convex shape that will extend from an open end of the tube past a location where the tube would be metallurgically bonded to a header.

30. The insert of claim 29 wherein said insert further comprises a clip to hold the insert on the end of the flattened tube.

31. The insert of claim 29 wherein said projection terminates in a free end having a pilot formation thereon to be freely received in the flattened tube end.

32. The insert of claim 31 wherein said pilot formation is a rounded end.

33. The insert of claim 32 wherein all but the end of the C-shaped projection has a slightly greater side-to-side dimension than said tubes to provide an interference fit of said projection in said tube end.

34. An insert for strengthening the end of a flattened heat exchanger tube in the area where the tube will be metallurgically bonded to a header, said tube having a rectangular cross section defined by two spaced broad sides joined by two spaced short sides, the insert comprising: a projection being formed from a plate and having a length sufficient to extend from an end of said tube past a point where said tube would be metallurgically bonded to a header, said length having a cross-sectional shape adapted to conform to one of said short sides of said tube to allow said projection to be bonded to said one of said short sides, said cross-sectional shape of said projection extending between the broad sides and extending over less than one half of the broad sides adjacent said one of said short sides.

35. The insert of claim 34 further comprising a clip adjacent an end of said insert to hold the insert on the end of said tube.

36. The insert of claim 35 wherein said projection terminates in a free end having a pilot formation thereon to be freely received in said flattened tube end.

37. The insert of claim 36 wherein said pilot formation is a rounded end.

38. The insert of claim 37 wherein all but said end of said projection has a slightly greater side-to-side dimension than said one of said short sides to provide an interference fit in said tube end.

39. A method of strengthening a tube to header joint in a heat exchanger having a flattened tube comprising the steps of: a) inserting the end of a flattened tube into a tube slot of a header for a heat exchanger; b) placing an insert having a C-shaped projection on the end of the tube such that the projection is at least nominally in contact with a rounded wall of the tube and extends past an interface of the tube and the header whereat the tube to header joint is to be formed; and c) metallurgically bonding the header, the tube, and the insert into a unitary structure.

40. The method of claim 39 wherein step b) includes clipping the insert to the tube using a tab integrally formed on the insert.

41. The method of claim 39 wherein step b) includes interference fitting the projection within the tube end.

* * * * *